US012662939B2

(12) United States Patent
Perry

(10) Patent No.: US 12,662,939 B2
(45) Date of Patent: Jun. 23, 2026

(54) GUIDE SHOE FOR MINING MACHINE

(71) Applicant: Joy Global Underground Mining LLC, Warrendale, PA (US)

(72) Inventor: Ryan E. Perry, Venus, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 18/526,491

(22) Filed: Dec. 1, 2023

(65) Prior Publication Data

US 2024/0183272 A1 Jun. 6, 2024

Related U.S. Application Data

(60) Provisional application No. 63/429,440, filed on Dec. 1, 2022.

(51) Int. Cl.
*E21C 29/02* (2006.01)

(52) U.S. Cl.
CPC ..... *E21C 29/02* (2013.01)

(58) Field of Classification Search
CPC ..... E21C 29/02
See application file for complete search history.

(56) References Cited

U.S. PATENT DOCUMENTS 3,950,031 A 4/1976 Krekeler
4,088,370 A * 5/1978 Jarvis ..... E21C 35/12 299/53
4,236,758 A * 12/1980 Groger ..... E21C 29/02 105/29.1
4,943,120 A * 7/1990 Groger ..... E21C 29/10 105/29.1
5,931,541 A 8/1999 Pietrzyk et al.
8,944,519 B2 2/2015 Pietrala
9,273,552 B2 3/2016 Pietrala
9,309,763 B2 4/2016 Niederriter et al.
2010/0019563 A1* 1/2010 Thomson ..... E21C 29/02 299/43

FOREIGN PATENT DOCUMENTS

CN 101307690 A 11/2008
CN 203430509 U 2/2014

* cited by examiner

*Primary Examiner* — Janine M Kreck
(74) *Attorney, Agent, or Firm* — Husch Blackwell LLP

(57) ABSTRACT

A guide shoe for a mining machine includes a shoe body, a through hole, and a support. The shoe body is configured to engage a rack. The through hole extends between a first wall of the shoe body and a second wall of the shoe body, and the through hole extends along a central axis. The support is coupled to the first wall, and the support is configured to engage a shaft coupled to a drive sprocket engaging the rack. At least one of the shaft and the support is movable between a first configuration and a second configuration. The rotation axis is spaced apart from the rack by a first sprocket distance in the first configuration, and the rotation axis is spaced apart from the rack by a second sprocket distance in the second configuration.

21 Claims, 16 Drawing Sheets

GUIDE SHOE FOR MINING MACHINE

CROSS-REFERENCE TO RELATED APPLICATIONS

This application claims priority to prior-filed, co-pending U.S. Provisional Patent Application No. 63/429,440, filed on Dec. 1, 2022, the entire contents of which are incorporated herein by reference.

FIELD

The present disclosure relates to the field of mining machines and particularly to a guide shoe for a longwall mining machine.

BACKGROUND

Conventional longwall shearers include a frame and a pair of cutting assemblies mounted on each end of the frame. Each cutting assembly includes a cutting drum for engaging a mine wall. As the frame traverses a mine face, the cutting drums cut material from the mine face. In some embodiments, the material is deposited on a conveyor and carried away from the mine face. The shearer includes a trapping shoe and sprocket that engage a rack to guide the machine with respect to the mine wall. During operation, the trapping shoe wears down, resulting in poor engagement between the sprocket and the rack and reduced machine control.

SUMMARY

In one independent aspect, a guide shoe for a mining machine includes a shoe body, a through hole, and a support. The shoe body has a first end and a second end, and the shoe body is configured to engage a rack. The through hole extends between a first wall of the shoe body and a second wall of the shoe body, and the through hole extends along a central axis. The support is coupled to the first wall, and the support is configured to engage a shaft coupled to a drive sprocket engaging the rack. The support includes a pin slot having a first slot edge and a second slot edge opposite the first slot edge, the pin slot having a slot center point that is vertically offset from the central axis.

In some aspects, a first slot distance extends between the first slot edge and the central axis, and a second slot distance extends between the second slot edge and the central axis, wherein the first slot distance is greater than the second slot distance.

In some aspects, a first slot distance extends between the first slot edge and the central axis, and a second slot distance extends between the second slot edge and the central axis, wherein the second slot distance is greater than the first slot distance.

In some aspects, the support is selectively positionable within the through hole in a first support configuration and a second support configuration.

In some aspects, a first slot distance extends between the first slot edge and the central axis, and a second slot distance extends between the lower slot edge and the central axis. While the support is in the first support configuration, the drive sprocket is positioned at a first sprocket distance relative to the rack and, while the support is in the second support configuration, the drive sprocket is positioned at a second sprocket distance relative to the rack that is less than the first sprocket distance.

In some aspects, the guide shoe further includes the shaft engaging the support, the shaft extending between the first wall and the second wall.

In some aspects, the shaft defines an axis of rotation of the sprocket, and wherein a center point of the pin slot is offset from the axis of rotation.

In another independent aspect, a drive mechanism for a mining machine is configured to engage and move the mining machine along a rack. The drive mechanism includes a sprocket configured to engage the rack, a shaft supporting the sprocket for rotation about a rotation axis, a guide shoe configured to maintain engagement between the sprocket and the rack, and a support. Rotation of the sprocket is configured to move the mining machine relative to the rack. The guide shoe has a shoe body including a first end, a second end, and a rack slot extending between the first end and the second end along a rack slot axis. The support is coupled to the shoe body, and the support includes a shaft slot having a first slot edge and a second slot edge opposite the first slot edge. The shaft slot has a slot center point, and the support is coupled to the shaft. At least one of the shaft and the support is movable between a first configuration and a second configuration. The rotation axis is spaced apart from the rack by a first sprocket distance in the first configuration, and the rotation axis is spaced apart from the rack by a second sprocket distance in the second configuration.

In some aspects, the rack includes a rack tooth and the sprocket includes a sprocket tooth. In the first configuration the sprocket tooth overlaps the rack tooth by a first amount and, in the second configuration the sprocket tooth overlaps the rack tooth by a second amount, and the first amount is less than the second amount.

In some aspects, the shoe body further includes a first wall, a second wall spaced apart from the first wall, and a through hole that extends through the first wall and the second wall, the through hole extending along a central axis.

In some aspects, the shaft extends along a shaft axis, and the shaft axis is vertically offset from the central axis.

In some aspects, the shaft includes a first planar surface and a second planar surface. A distance between the first planar surface and the central axis is a first shaft distance, and a distance between the second planar surface and the central axis is a second shaft distance, the first shaft distance being different from the second shaft distance.

In some aspects, in the first configuration, the first shaft distance is greater than the second shaft distance.

In some aspects, in the second configuration, the first shaft distance is less than the second shaft distance.

In some aspects, the shaft extends along a shaft axis, and the slot center point is vertically offset from the central axis.

In some aspects, the shaft support further includes a first distance between the first slot edge and the central axis and a second distance between the second slot edge and the central axis, the first distance being different from the second distance.

In some aspects, the support is selectively positionable within the through hole in the first configuration or the second configuration. While the support is in the first configuration, the drive sprocket is positioned at a first sprocket distance relative to the rack, and, while the support is in the second configuration, the drive sprocket is positioned at a second sprocket distance relative to the rack that is less than the first sprocket distance.

In yet another independent aspect, a guide shoe for a mining machine includes an elongated shoe body, a shaft for supporting a sprocket for rotation about a rotation axis, and a pair of supports. The elongated shoe body includes a first end, a second end, a slot extending between the first end and the second end along a rack slot axis, a first lug, and a second lug spaced apart from the first lug. The shaft includes a first end and a second end. The pair of supports includes a first support and a second support. The first support is coupled to the first lug and engages the first end of the shaft, and the second support is coupled to the second lug and engages the second end of the shaft. At least one of the shaft and the pair of supports is movable between a first configuration and a second configuration. The shoe body is supported in a first position relative to the sprocket in the first configuration, and the shoe body is supported in a second position relative to the sprocket in the second configuration.

In some aspects, in the first position, the rack slot axis is positioned at a first distance from the rotation axis, and, in the second position, the rack slot axis is positioned at a second distance from the rotation axis.

In some aspects, the first lug includes a first opening extending along a central axis, and the second lug includes a second opening that is aligned with the central axis.

In some aspects, the first support is positioned in the first opening and includes a first slot, the first slot having a first slot edge and a second slot edge opposite the first slot edge, the slot having a slot center point that is offset from the central axis.

In some aspects, a first slot distance extends between the first slot edge and the slot center point, and a second slot distance extends between the second slot edge and the slot center point, wherein the first slot distance is different from the second slot distance.

In some aspects, the shaft includes a first planar surface and a second planar surface. A distance between the first planar surface and the central axis is a first shaft distance, and a distance between the second planar surface and the central axis is a second shaft distance, the first shaft distance being different from the second shaft distance.

Other aspects will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings, and can include electrical or fluid connections or couplings, whether direct or indirect. Also, electronic communications and notifications may be performed using any known means including direct connections, wireless connections, etc.

Figure 1:
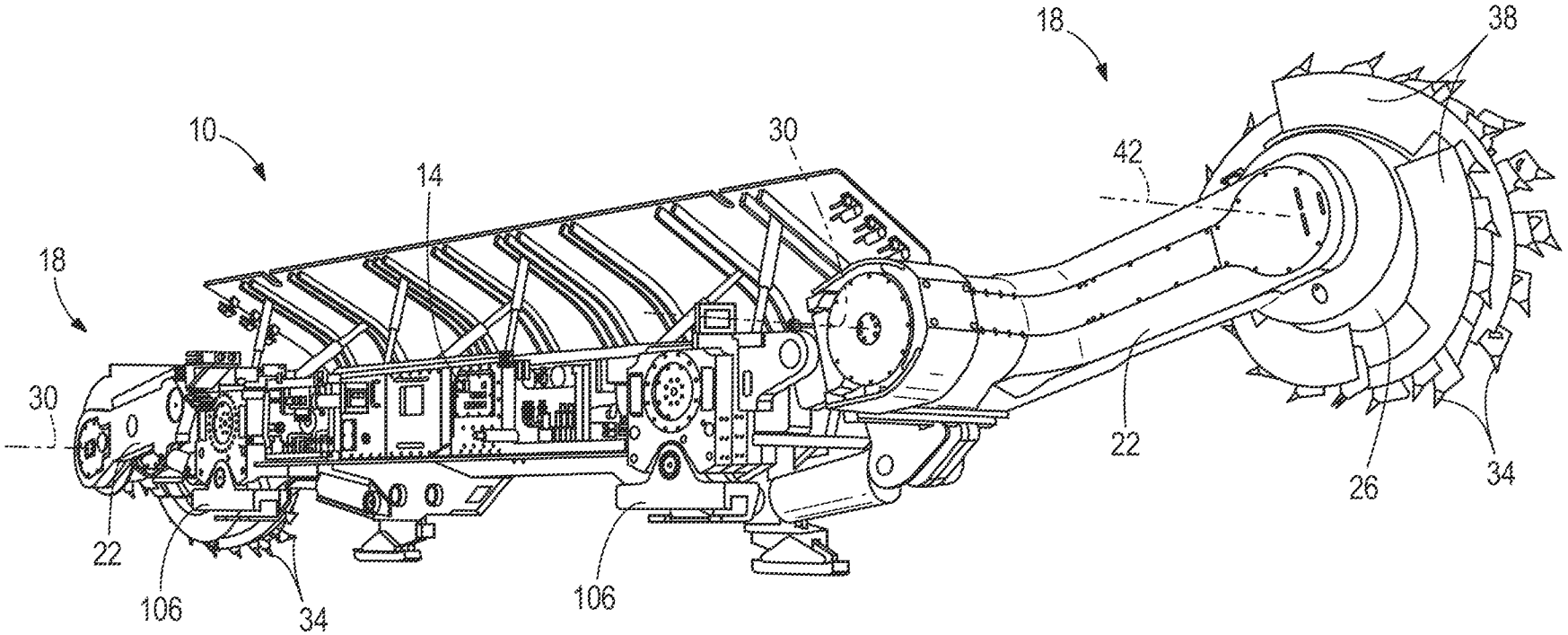
FIG. 1 is a perspective view of a mining machine.

FIG. 1 illustrates a mining machine, such as a longwall shearer 10. In the illustrated embodiment, the shearer 10 includes a chassis or frame 14 and a pair of cutting assemblies 18. Each cutting assembly 18 includes a ranging arm 22 and a cutting drum 26. Each ranging arm 22*a*, 22*b* (FIG. 2) is pivotably coupled to a respective end of the frame 14 and pivots about an arm axis 30. Each ranging arm 22*a*, 22*b* also rotatably supports the associated cutting drum 26*a*, 26*b*. Each cutting drum 26*a*, 26*b* (FIG. 2) includes a generally cylindrical body and cutting bits 34. In the illustrated embodiment, vanes 38 (FIG. 1) extend in a helical manner along an outer surface or periphery of the cutting drum 26, and the cutting bits 34 are positioned along the edges of the vanes 38 (for simplicity, the cutting drum 26 and vanes 38 are illustrated as a cylinder in FIG. 2). The cutting drum 26 is coupled to the associated ranging arm 22 and is rotatable about a drum axis 42 that is substantially parallel to the arm axis 30.

Figure 2:
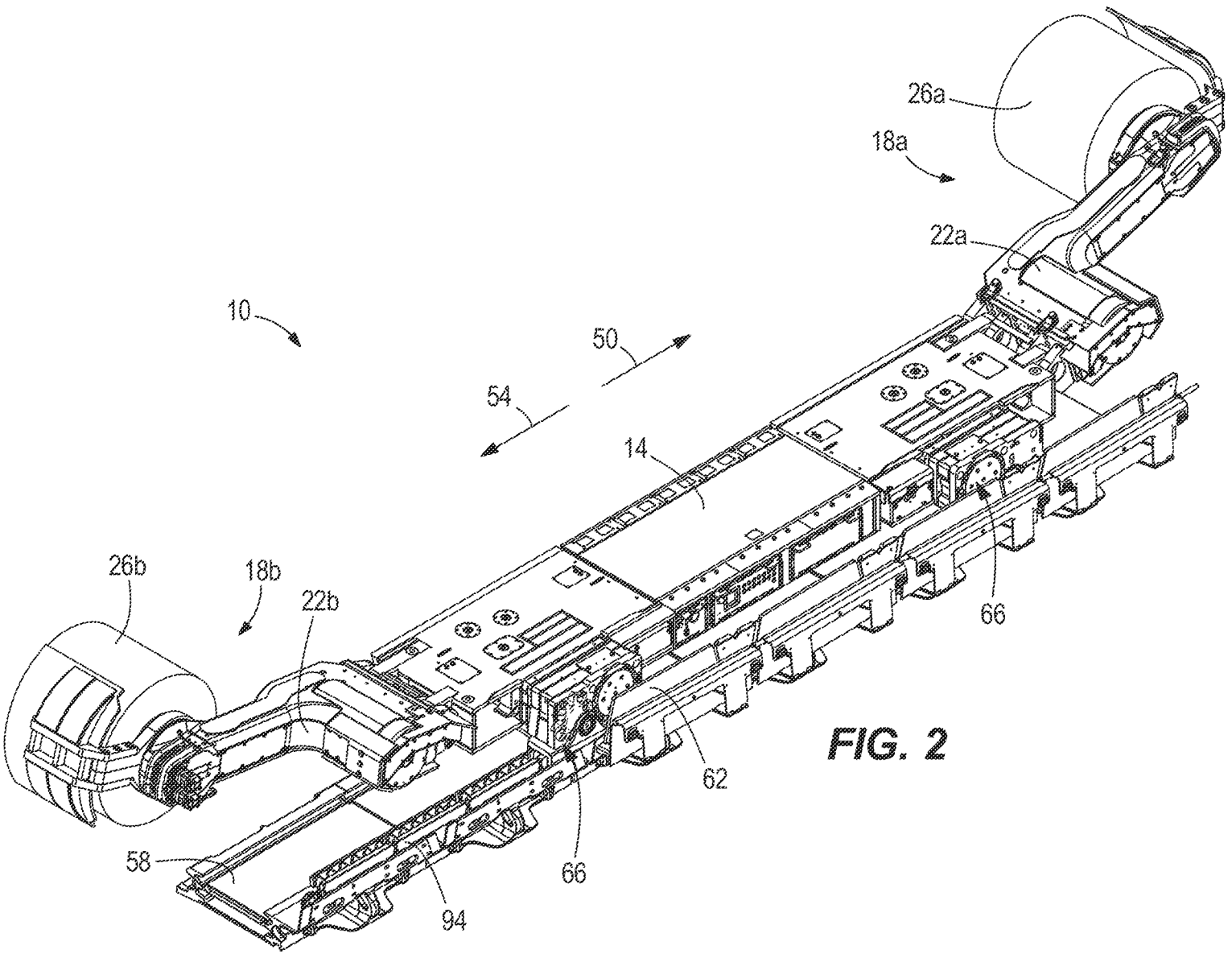
FIG. 2 is another perspective view of the mining machine of FIG. 1.

As shown in FIG. 2, the frame 14 is configured to tram or move along a mine face or wall of material to be mined in a first direction 50 and a second direction 54. Each cutting drum 26 engages the mine wall such that the cutting bits 34 (FIG. 1) cut material from the wall. As the cutting drum 26 rotates, the vanes 38 (FIG. 1) carry the cut material from the wall toward a rear end of the cutting drum 26, where the cut material is deposited onto a face conveyor 58 (FIG. 2). The face conveyor 58 carries the material toward a gate conveyor to be transported out of the mine. In the illustrated embodiment, one or more spill plates 62 are positioned behind the frame 14 (i.e., away from the wall) to prevent cut material from falling behind the face conveyor 58. In FIG. 2, one of the spill plates 62 is removed to clearly show a portion of the face conveyor 58. In addition, one or more roof supports (not shown) may be positioned behind the face conveyor 58 and the spill plates 62.

As shown in FIG. 2, as the frame 14 moves in the first direction 50, a first cutting assembly 18*a* is in a leading position and a second cutting assembly 18*b* is in a trailing position. In one embodiment, the leading position is an elevated position in order to cut material (e.g., coal) from an upper portion of the mine wall, while the trailing position is a lower position to cut material from a lower portion of the mine wall.

Figure 3:
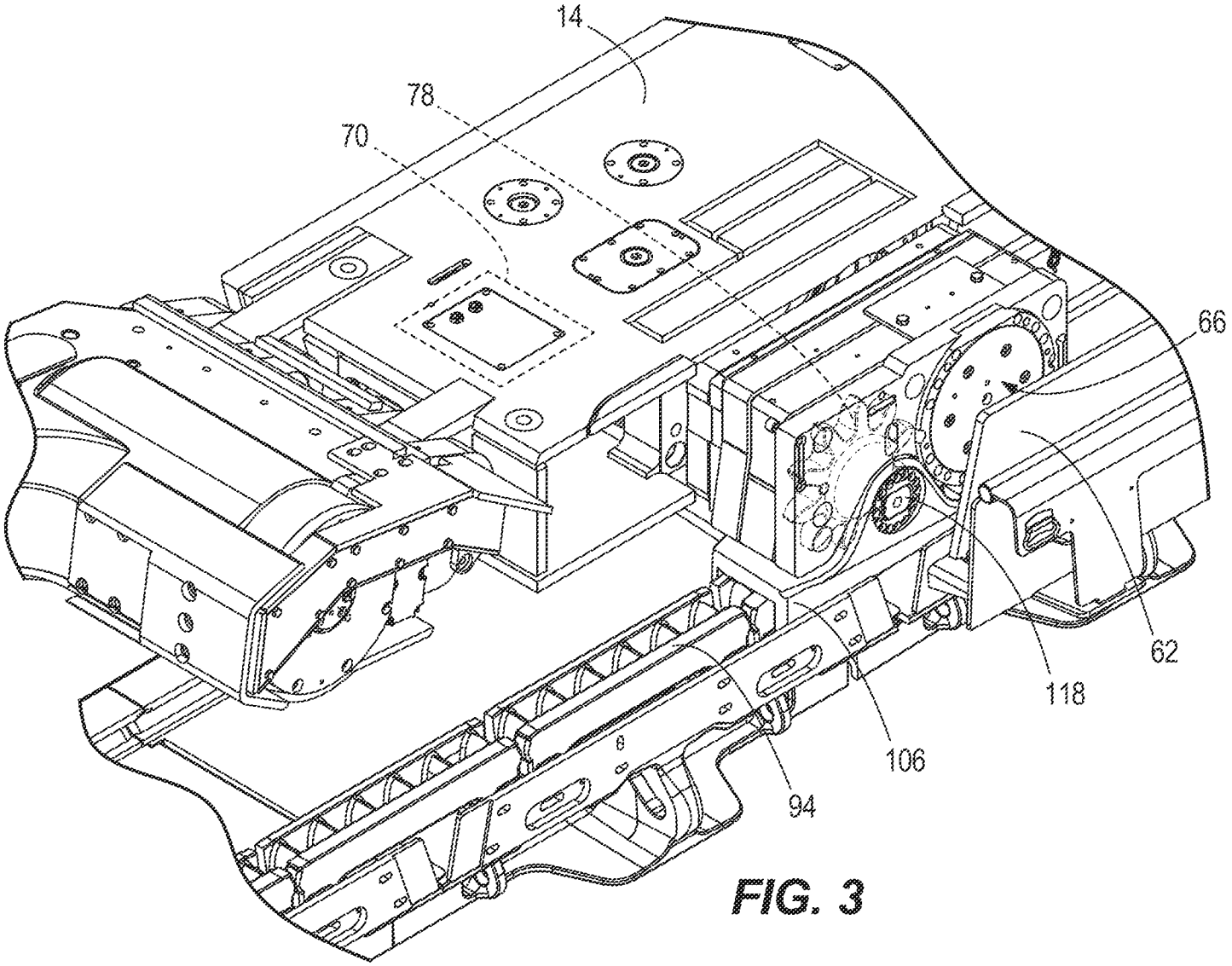
FIG. 3 is an enlarged perspective view of a portion of the mining machine of FIG. 1.
Figure 4:
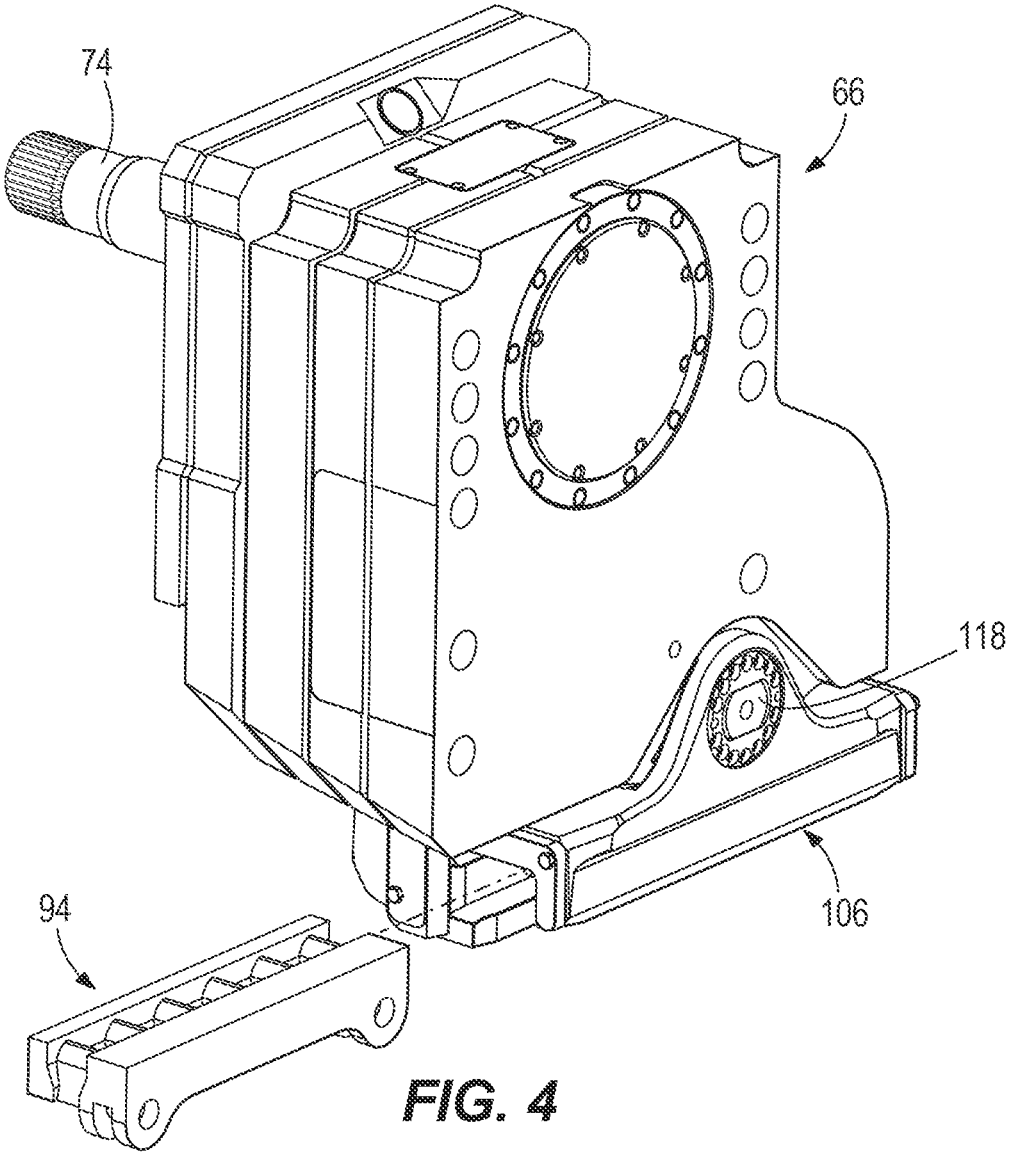
FIG. 4 is a perspective view of a drive mechanism.

Referring now to FIG. 3, the frame 14 includes a drive mechanism 66 for moving the frame 14. FIGS. 3 and 4 illustrate a drive mechanism 66 according to some embodiments. The drive mechanism 66 includes a motor 70 (FIG. 3) driving an output shaft 74 (FIG. 4), which drives a gear or a drive sprocket 78 (FIG. 3). In the illustrated embodiment, the output shaft 74 drives a gear train that rotates the sprocket 78. Also, in the illustrated embodiment, a rack 94 is coupled to the face conveyor 58 (FIG. 2) and extends along the wall. The sprocket 78 engages the rack 94 to form a rack-and-pinion connection. Rotation of the sprocket 78 causes translational movement of the frame 14 along the rack 94.

Figure 6:
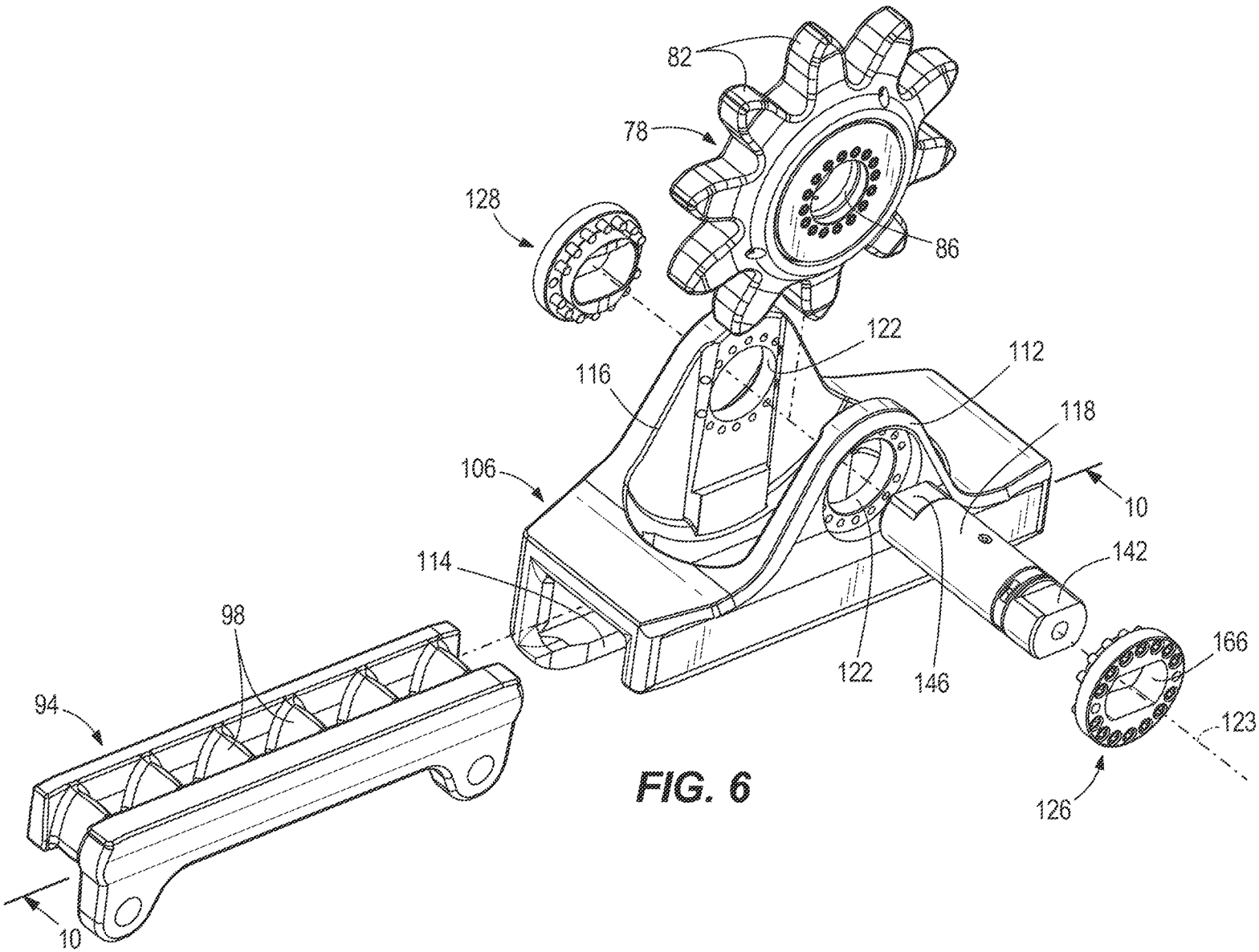
FIG. 6 is an exploded view of a sprocket, a rack, and the guide shoe of FIG. 5.

Referring to FIG. 6, the sprocket 78 includes a receiving hole 86 and a plurality of sprocket teeth 82 (e.g., gear teeth). In the illustrated embodiment, the receiving hole 86 is located at the center of the sprocket 78 and is configured to receive a shaft 118 (e.g., a pin). The sprocket teeth 82 extend outwardly from the receiving hole 86. Each of the sprocket teeth 82 includes a distal end 90 (FIG. 10) positioned radially outward of the receiving hole 86. In the illustrated embodiment, the sprocket 78 has ten sprocket teeth 82, although fewer or more teeth could be used. The rack 94 also include a plurality of rack teeth 98 that are spaced apart from one another by a gap. The rack 94 is configured to receive a sprocket tooth 82 within the gap. Each of the rack teeth 98 includes a distal end 102 (FIG. 10) that is positioned proximate the surface along which the sprocket 78 engages the rack 94 (e.g., the upper side of the rack 94).

Referring again to FIGS. 4-6, a trapping shoe or guide shoe 106 is coupled to the frame 14 (FIG. 3) by the shaft 118. In the illustrated embodiment, the guide shoe 106 is supported for pivoting movement relative to the frame 14 by the shaft 118. The sprocket 78 is supported for rotation about the shaft 118, and the sprocket teeth 82 of the sprocket 78 extend through an opening of the guide shoe 106 to engage the rack teeth 98 of the rack 94. Among other things, the guide shoe 106 guides the movement of the frame 14 relative to the rack 94 along the mine face and maintains alignment and engagement between the sprocket 78 and the rack 94. In the illustrated embodiment, a guide shoe 106 is positioned proximate each end of the frame 14; in other embodiments, the mining machine 10 may include fewer or more guide shoes.

Figure 5:
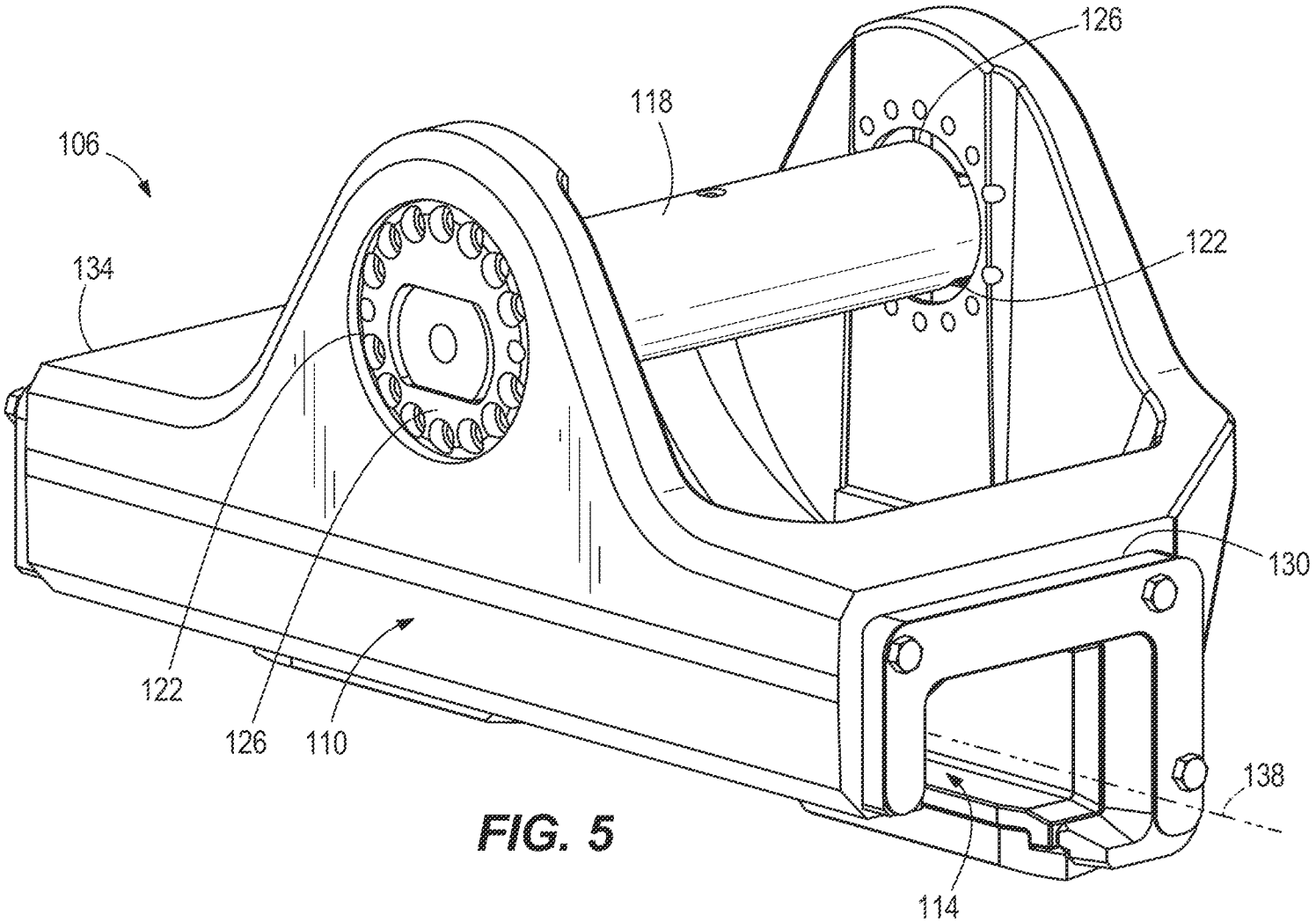
FIG. 5 is a perspective view of a guide shoe.

Referring to FIG. 5, the guide shoe 106 includes an elongated shoe body 110 coupled to the shaft 118. The shoe body 110 includes a first end 130, a second end 134, and a rack slot 114 that extends longitudinally between the first end 130 and the second end 134 along a rack slot axis 138. The rack slot 114 is sized to receive the rack 94. The shoe body 110 may include a hook that extends around a portion (e.g., the lower side) of the rack 94 to maintain engagement between the guide shoe 106 and the rack 94. In the illustrated embodiment, a cross-section of the rack slot 114 transverse to the rack slot axis 138 forms an incomplete rectangle.

In the illustrated embodiment, the guide shoe 106 further includes a first wall or first lug 112 positioned adjacent a first side of the shoe body 110, a second wall or second lug 116 positioned adjacent a second side of the shoe body 110, and a through hole 122 that extends through each of the first lug 112 and the second lug 116 along a central axis 123 (FIG. 6). While the through hole 122 can be considered a single through hole, it is formed by a first opening in the first lug 112 and a second opening in the second lug 116 with those openings being aligned and concentric with the central axis 123. As shown in FIG. 6, a first keeper 126 (e.g., a first shaft support or support) is positioned in the through hole 122 of the first lug 112, and a second keeper 128 (e.g., a second shaft support or support) is positioned in the through hole 122 of the second lug 116. In the illustrated embodiment, the second keeper 128 is substantially the same as the first keeper 126.

Figure 8:
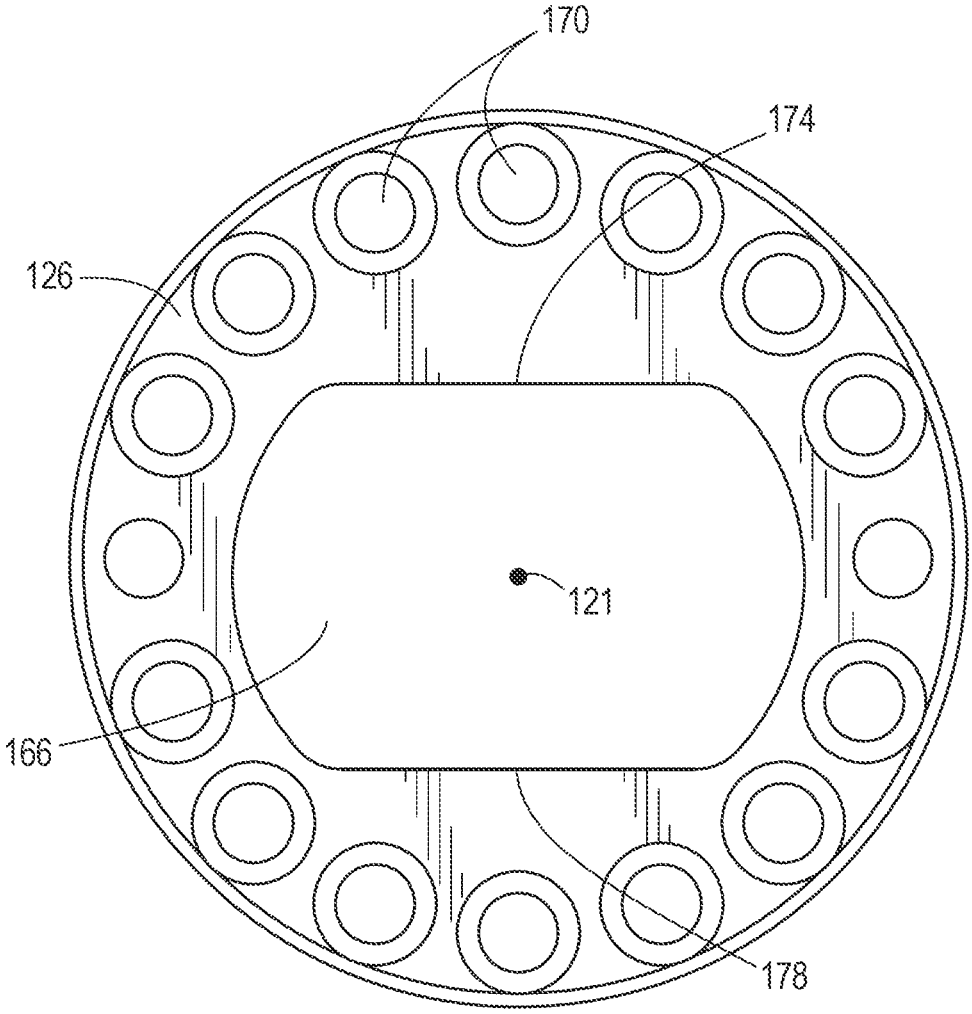
FIG. 8 is an elevation view of a shaft support.

Referring to FIG. 8, each of the keepers 126, 128 includes a slot 166 (e.g., a pin slot) and bores 170 positioned circumferentially about the perimeter of the keeper 126, 128. The slot 166 includes a first edge 174 (e.g., an upper slot edge in the orientation shown in FIG. 8) and a second edge 178 (e.g., a lower slot edge in the orientation shown in FIG. 8) opposite the first edge 174. The slot 166 has a slot center point 121 between the first edge 174 and the second edge 178. In the illustrated embodiment, each of the bores 170 is configured to receive a fastener (e.g., a bolt) to secure the keepers 126, 128 in a given orientation relative to the guide shoe 106.

Figure 9:
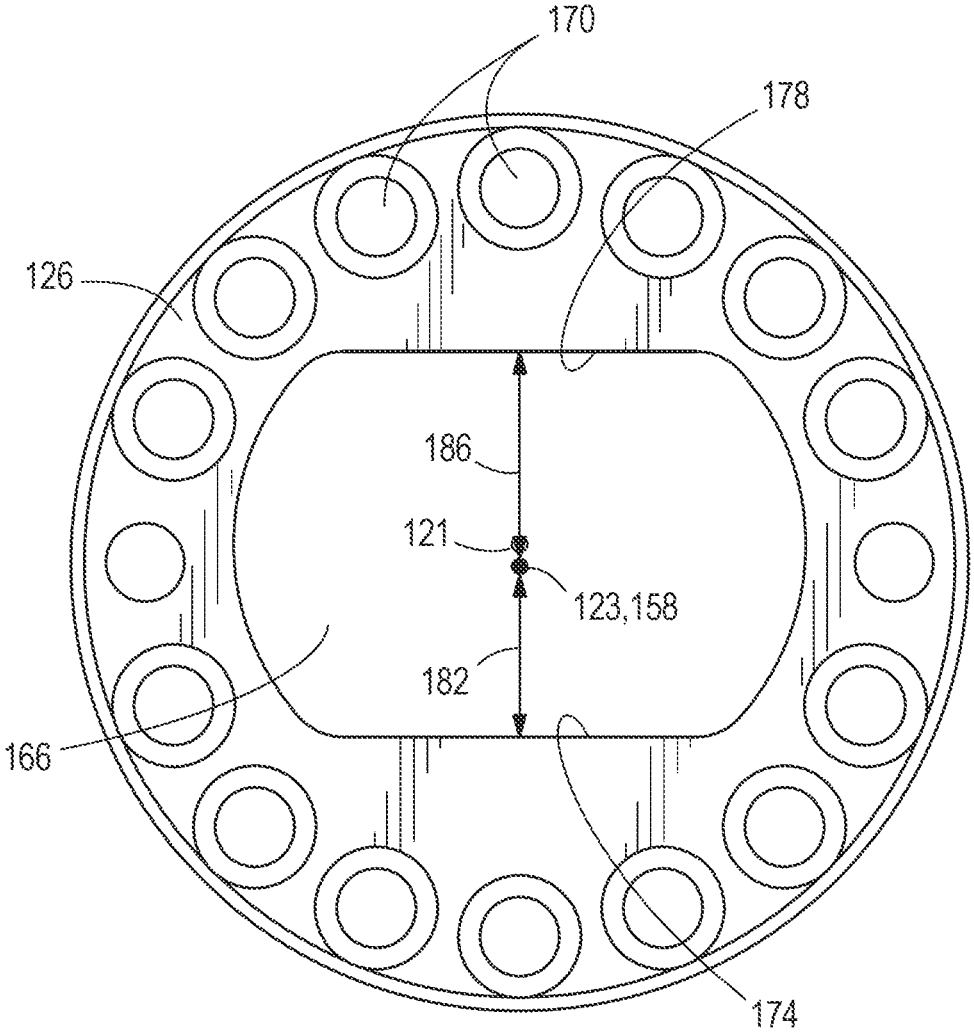
FIG. 9 is an elevation view of a shaft support in a first configuration.

With reference to FIG. 9, the keepers 126, 128 are offset keepers such that the slot center point 121 is offset from the central axis 123 of the through hole 122 (FIG. 6). In the illustrated embodiment, the first edge 174 is spaced apart from the central axis 123 by a first distance 182 (e.g., a first slot distance), and the second edge 178 is spaced apart from the central axis 123 by a second distance 186 (e.g., a second slot distance).

As shown in FIG. 6, the shaft 118 extends between the first lug 112 and the second lug 116. A first end 142 of the shaft 118 is coupled to the first keeper 126 and supported relative to the first lug 112, and a second end 146 of the shaft 118 is coupled to the second keeper 128 and supported relative to the second lug 116. The shaft 118 extends through the receiving hole 86 of the sprocket 78. In the illustrated embodiment, the shaft 118 is supported for rotation between the first end 142 and the second end 146. The shaft 118 defines a shaft axis 158 (FIG. 7B) that extends through the center of the shaft 118. In some embodiments, the shaft axis 158 may be coaxial with the central axis 123, and in other embodiments, the shaft axis 158 may be vertically offset from the central axis 123.

Figure 7A:
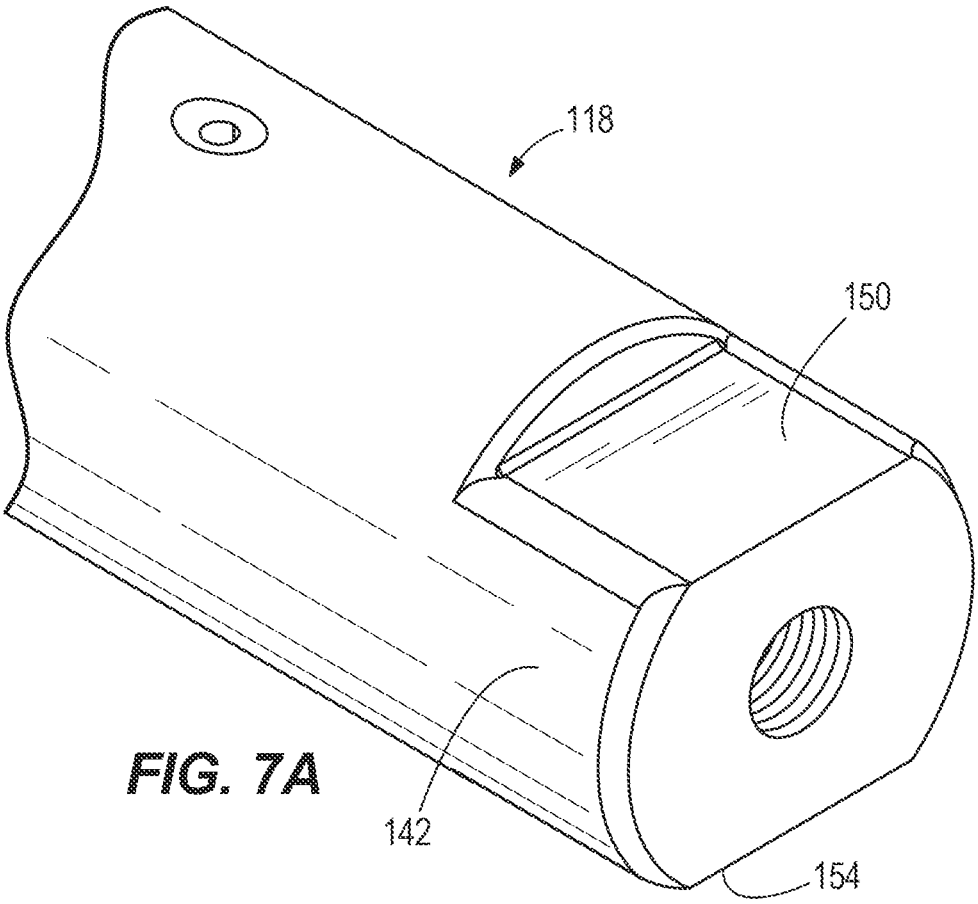
FIG. 7A is a partial perspective view of an end of a shaft.
Figure 7B:
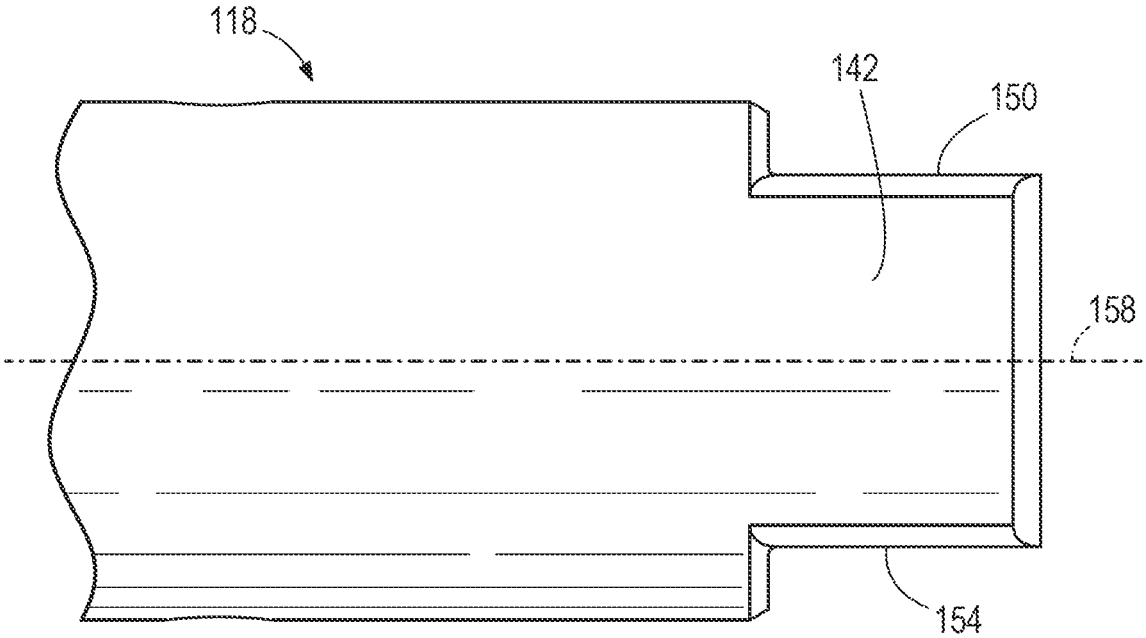
FIG. 7B is a partial side view of the shaft of FIG. 7A.

With reference to FIGS. 7A and 7B, in the illustrated embodiment, the first end 142 and second end 146 of the shaft 118 each include two planar surfaces. A first planar surface 150 (e.g., an upper shaft edge as shown in the orientation of FIG. 7B) is disposed on one side of the shaft axis 158 and a second planar surface 154 (e.g., a lower shaft edge as shown in the orientation of FIG. 7B) is disposed on the other side of the shaft axis 158. The first planar surface 150 and the second planar surface 154 each engage one of the edges 174, 178 of each of the keepers 126, 128, thereby inhibiting rotation of the shaft 118 relative to the keepers 126, 128. The shaft 118 may include arcuate surfaces positioned circumferentially between the planar surfaces 150, 154.

Figure 10:
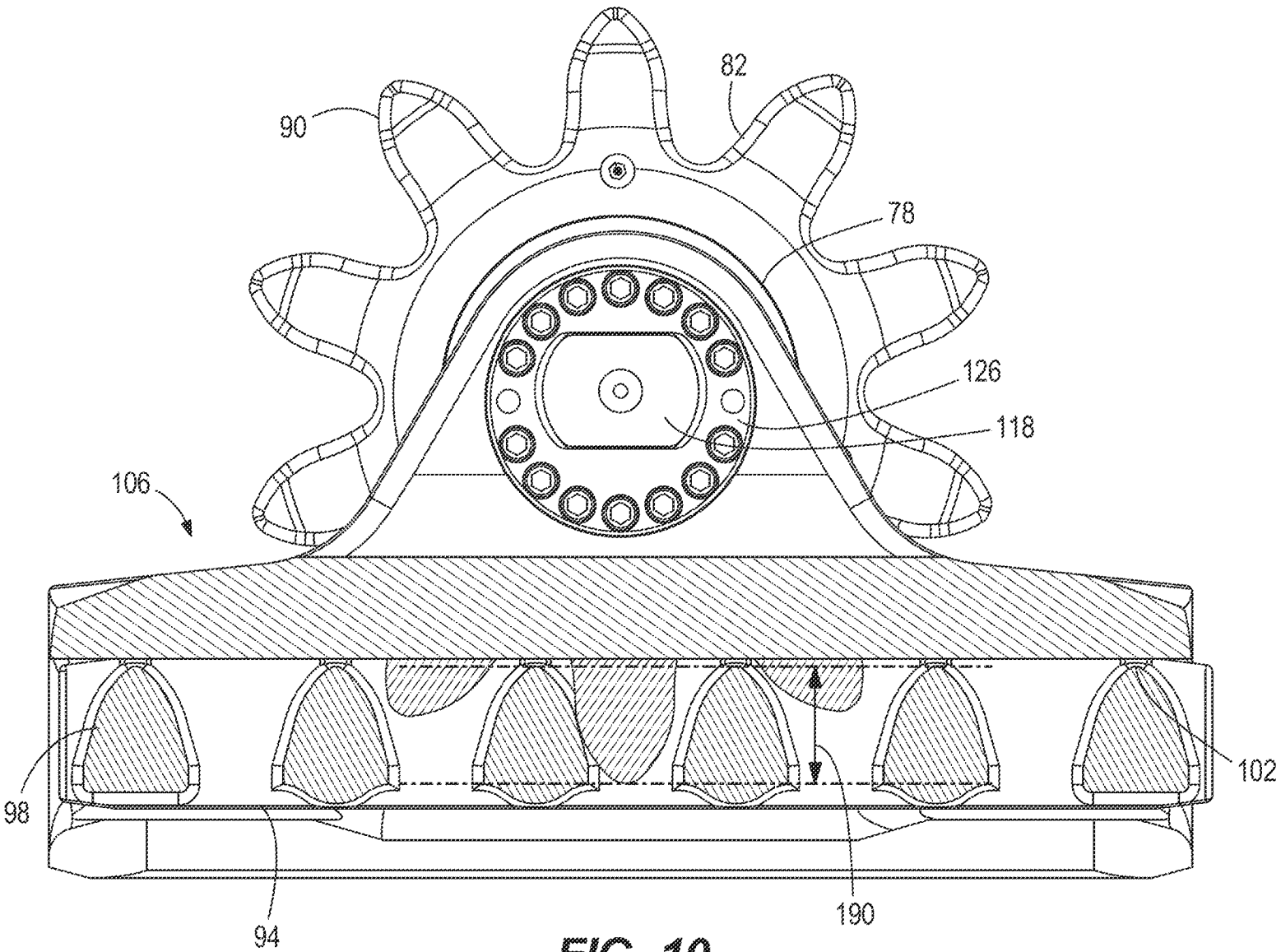
FIG. 10 is a section view of the sprocket, rack, and guide shoe of FIG. 6 viewed along section 10-10 with a lug shown, with shaft supports in the first configuration.
Figure 11:
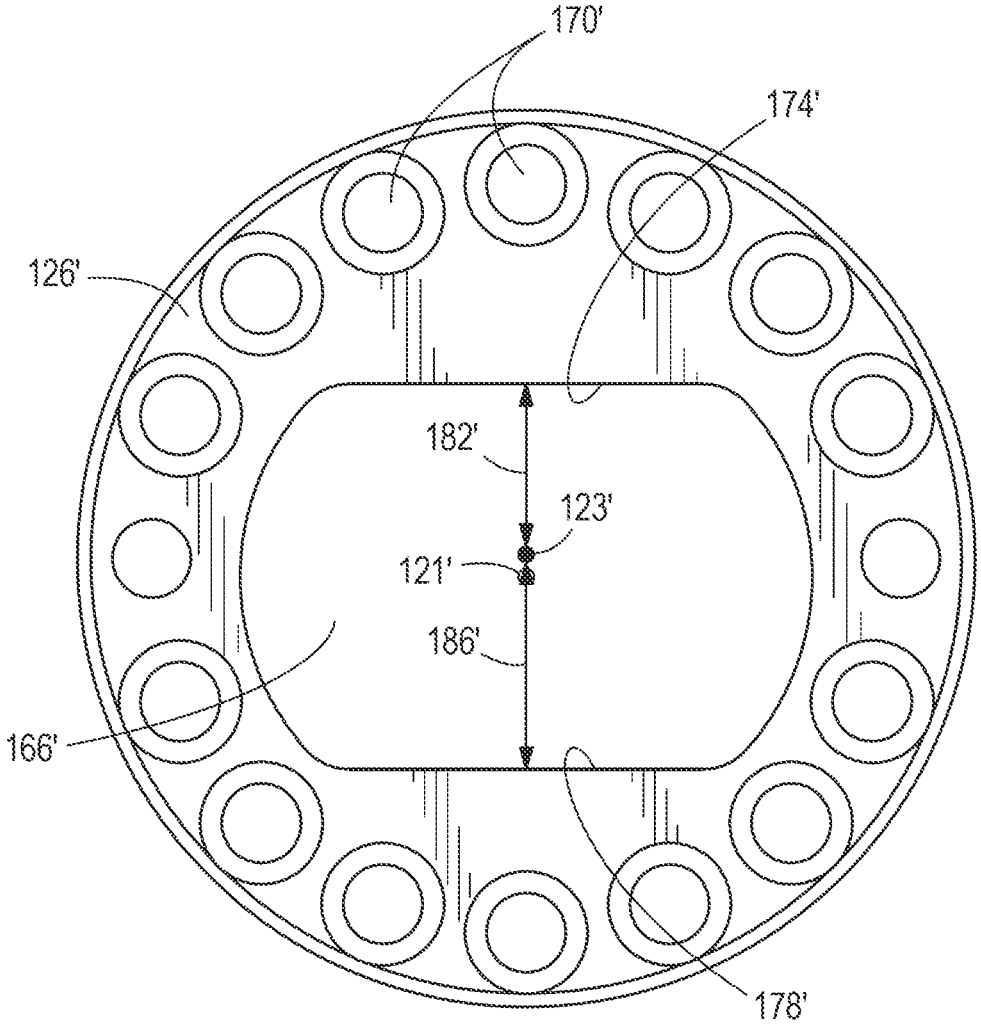
FIG. 11 is an elevation view of the shaft support of FIG. 9 in a second configuration.
Figure 12:
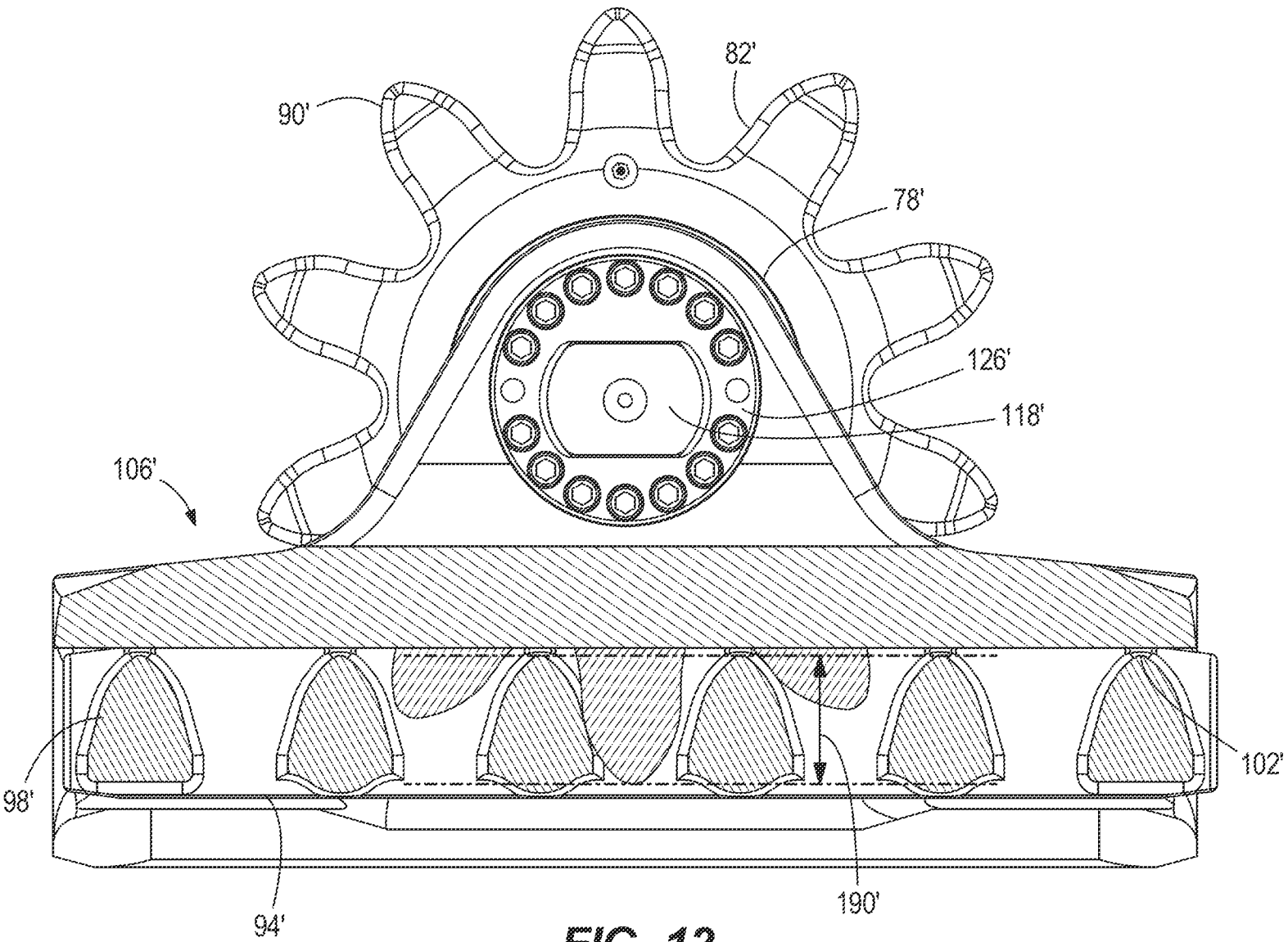
FIG. 12 is a section view of the sprocket, rack, and guide shoe of FIG. 6 viewed along section 10-10, with shaft supports in the second configuration.

FIG. 10 illustrates the guide shoe 106 in a first position (e.g., a position in which the axis of rotation of the sprocket 78 is elevated or spaced from the rack 94 by a first gear distance), and FIG. 12 illustrates a guide shoe 106' in a second position (e.g., a position in which the axis of rotation of the sprocket 78 is lowered or spaced apart from the rack 94 by a second gear distance that is less than the first gear distance). The guide shoe 106 is in the first position when both of the keepers 126, 128 are positioned in the through hole 122 in a first configuration (e.g., a first support configuration, FIG. 9) and the guide shoe 106' is in the second position when both of the keepers 126', 128' are positioned in the through hole 122 in a second configuration (e.g., a second support configuration, FIG. 11). Some differences between the guide shoe 106 in the first position and the guide shoe 106' in the second position are described herein, and similar features are labeled with similar reference numbers, plus a single mark (').

With reference to FIGS. 9 and 10, the keepers 126, 128 are in the first configuration and the guide shoe 106 is in the first position. The slot center point 121 is vertically offset from the shaft axis 158 and the central axis 123. While the guide shoe 106 is in the first position, the first distance 182 from the first edge 174 to the shaft axis 158 and the central axis 123 is less than the second distance 186 from the second edge 178 to the central axis 123. As a result, the axis of rotation of the sprocket 78 is spaced further from the rack 94.

With reference to FIGS. 11 and 12, the keepers 126', 128' are in a second configuration such the guide shoe 106' is in the second position. The slot center point 121' of the slot 166' is vertically offset from the shaft axis 158' and the central axis 123'. The first distance 182' from the first edge 174' to the shaft axis 158' and the central axis 123' is greater than the second distance 186' from the second edge 178' to the central axis 123'. As a result, the axis of rotation of the sprocket 78 is positioned closer to the rack 94'.

In some embodiments, an overlap distance 190, 190' (FIGS. 10 and 12) may be measured between the distal end 102, 102' of one of the rack teeth 98, 98' to the distal end 90, 90' of a sprocket tooth 82, 82' that is in a lowermost position. When the guide shoe 106 is in the first position, one of sprocket teeth 82 overlaps or penetrates between the rack teeth 98 by a first amount. When the guide shoe 106' is in the second position, one of sprocket teeth 82' overlaps or penetrates between the rack teeth 98' by a second amount. The first amount is less than the second amount, and the overlap distance 190' (e.g., when the guide shoe 106' is in the second position) is greater than the overlap distance 190 (e.g., when the guide shoe 106 is in the first position). In other embodiments, the distance between the distal end 102 of the rack teeth 98 and the distal end 90 of the sprocket tooth 82 may be different depending on relative wear.

The shearer 10 can move along the rack 94 while the guide shoe 106 is in either the first position or the second position. The offset keepers 126, 128, 126', 128' allow the guide shoe 106, 106' to be adjusted based on the condition of the shearer 10 to reduce the amount of wear on the sprocket 78, 78'. The guide shoe 106, 106' can easily switch between the first configuration and the second configuration by changing the orientation of the keepers 126, 128, 126', 128' (e.g., rotating the keeper by 180 degrees). Changing the orientation of the keepers 126, 128, 126', 128' adjusts the position of the sprocket 78, 78' relative to the rack 94.

When the keepers 126, 128 are in the first configuration (FIGS. 9 and 10), a distance between the first edge 174 and the rack 94 is less than a distance between the second edge 178 and the rack 94 (for example, the first edge 174 is a lower edge). When the keepers 126', 128' are in the second configuration (FIGS. 11 and 12), a distance between the second edge 178' and the rack 94' is less than a distance between the first edge 174' and the rack 94' (for example, the second edge 178 is a lower edge). The orientation of the keepers 126, 128 can be changed by an operator. For example, the operator may first uncouple the keepers 126, 128 from the guide shoe 106 (e.g., by unfastening the fasteners from the bores 170). Then, the operator re-positions the keepers 126, 128 in a different orientation. For example, the operator may rotate the keepers 126, 128 by 180 degrees (e.g., about the central axis 123), thereby moving one of the edges 174, 178 to be positioned farther from the rack 94 and moving the other one of the edges to be positioned closer to the rack 94. The operator then secures the keeper 126, 128 to the guide shoe 106 (e.g., by fastening the fasteners in the bores 170).

FIGS. 13A-16 illustrate a shaft 318, 318' for a guide shoe 306, 306' according to another embodiment. For the sake of brevity, some similarities and differences between the guide shoe 306, 306' and the guide shoe 106, 106' are described. Similar features are labeled with similar reference numbers, plus 200.

With respect to FIGS. 13A-16, a first keeper 326 (FIG. 14) and a second keeper (not shown) each have a slot 366 (e.g., a pin slot). In the illustrated embodiment, the slot 366 is centered with respect to the body of each keeper 326. For example, a center point 321 (FIG. 14) of the slot 366 may intersect or lie on a central axis 323 that extends between the lugs 112, 116 (FIG. 6) of the guide shoe 306. In other embodiments the slot could be offset as shown in FIGS. 5-11.

Figure 13A:
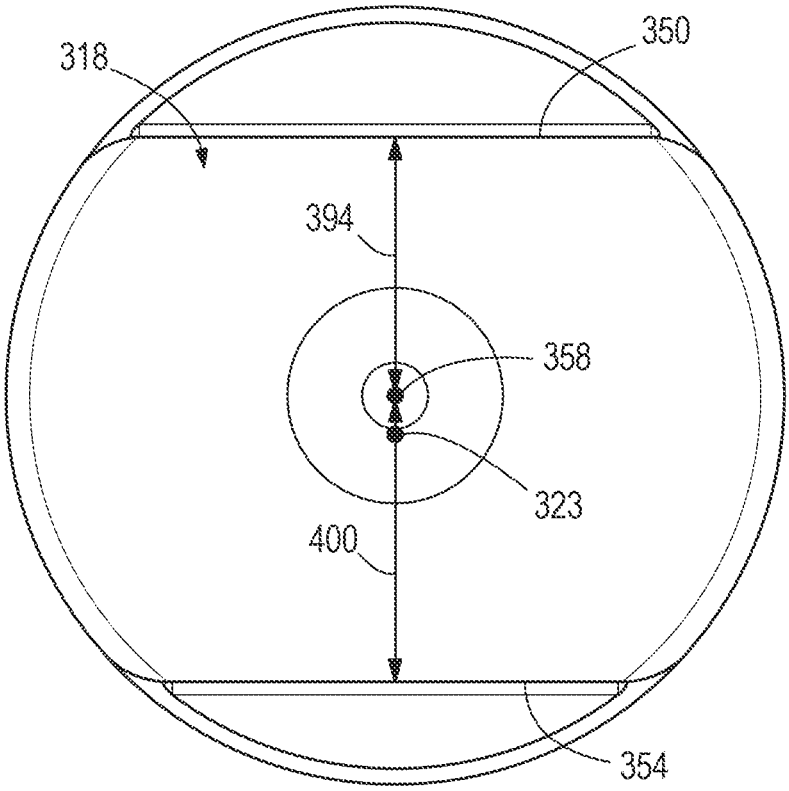
FIG. 13A is an end view of a shaft according to another embodiment, the shaft in a first configuration.
Figure 13B:
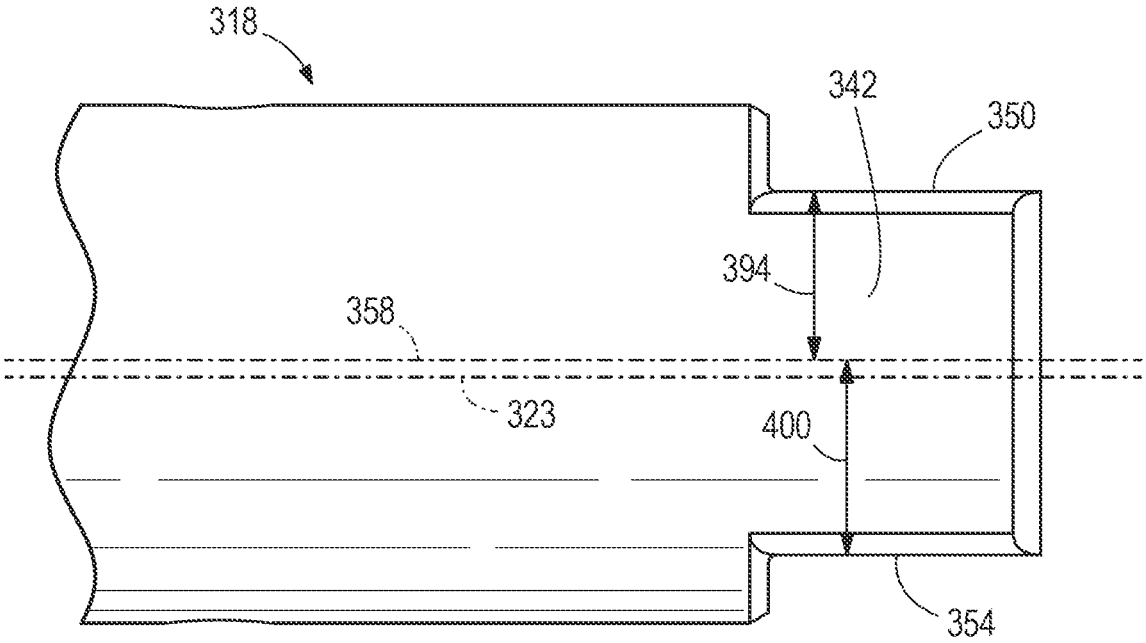
FIG. 13B is a partial side view of a portion of the shaft of FIG. 13A.
Figure 14:
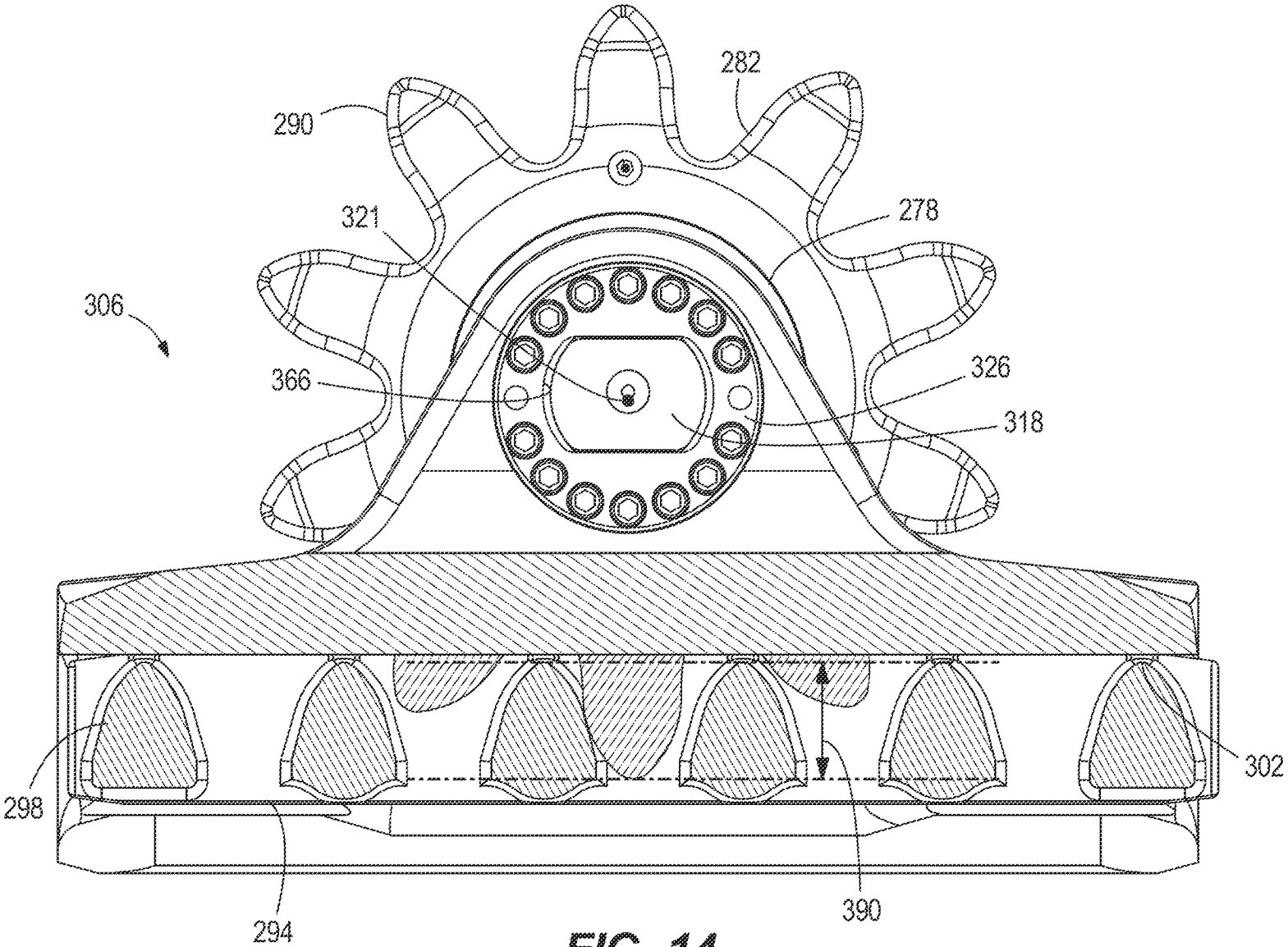
FIG. 14 is a section view of the sprocket, rack, and guide shoe viewed along section 10-10, with the shaft of FIG. 13A in the first configuration.

An end 342 of a shaft 318 is coupled to the first keeper 326. As shown in FIGS. 13A and 13B, the shaft 318 includes a first planar surface 350 (e.g., an upper shaft edge as shown in the orientation of FIG. 13B) and a second planar surface 354 (e.g., a lower shaft edge as shown in the orientation of FIG. 13B) adjacent each end of the shaft 318. A shaft axis 358 extends along the center of the shaft 318. In some embodiments, the shaft axis 358 may be coaxial with an axis of rotation of the sprocket 290 (FIG. 14). As shown in FIGS. 13B, the shaft axis 358 is vertically offset from the central axis 323. In the illustrated embodiment, the shaft axis 358 is also vertically offset from the center point 321 (FIG. 14) when the end 342 of the shaft 318 is coupled to the keeper 326. The planar surfaces 350, 354 are spaced apart from the shaft axis 358 by different distances. Stated another way, the first planar surface 350 is spaced from the shaft axis 358 by a first shaft distance 394, and the second planar surface 354 is spaced apart from the shaft axis 358 by a second shaft distance 400 that is different from the first shaft distance 394.

Figure 15A:
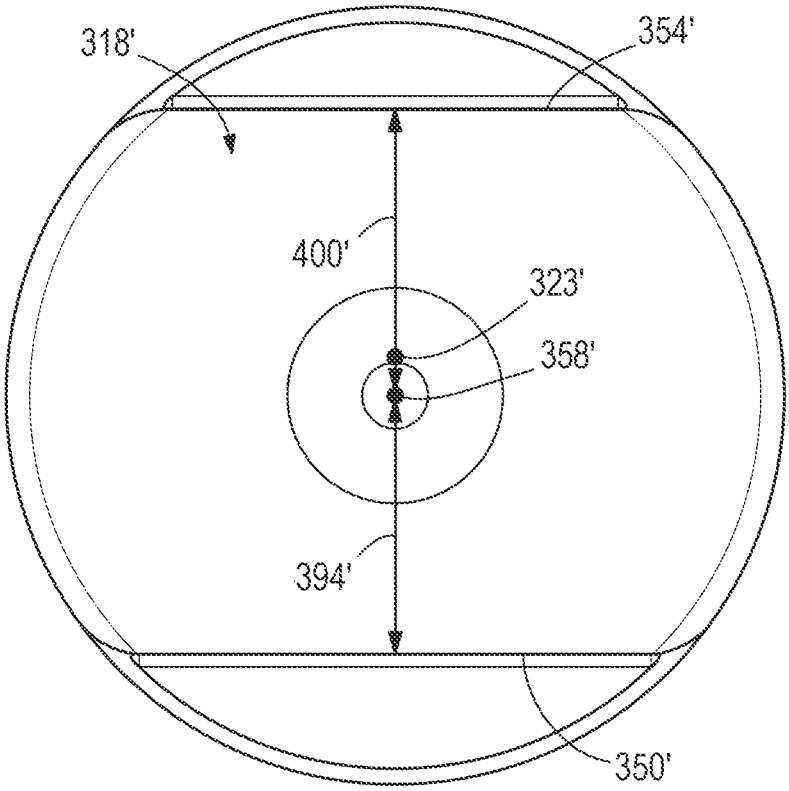
FIG. 15A is an end view of the shaft of FIG. 13A in a second configuration.
Figure 15B:
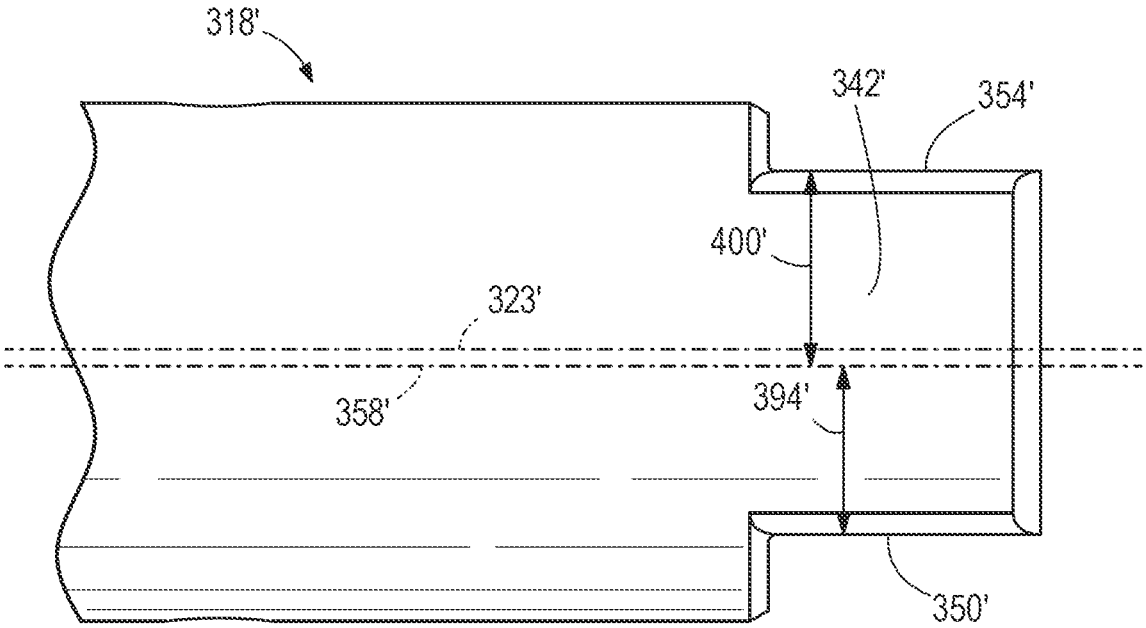
FIG. 15B is a partial side view of the shaft of FIG. 13A.
Figure 16:
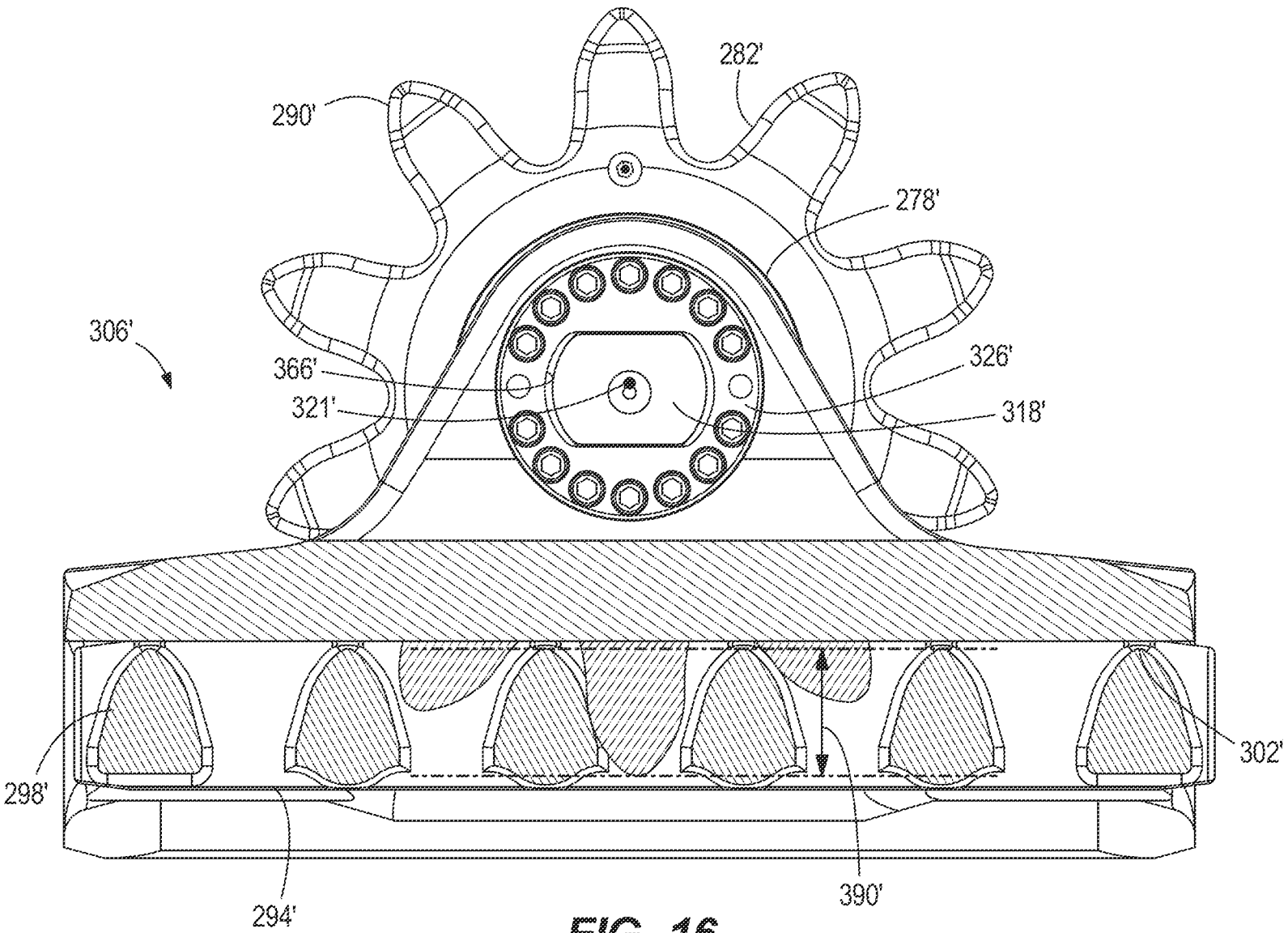
FIG. 16 is a section view of the sprocket, rack, and guide shoe viewed along section 10-10, with the shaft of FIG. 15A in the second configuration.

FIG. 14 illustrates the guide shoe 306 and shaft 318 in a first position (e.g., a position in which the axis of rotation of the sprocket 278 is elevated or spaced from the rack 294 by a first gear distance), and FIG. 16 illustrates the guide shoe 306' and shaft 318' in a second position (e.g., a position in which the axis of rotation of the sprocket 278 is lowered or spaced apart from the rack 294 by a second gear distance that is less than the first gear distance). The guide shoe 306 is in the first position when the shaft 318 is positioned in the slot 366 in a first configuration (e.g., a first shaft configuration, FIGS. 13A and 13B) and the guide shoe 306' is in the second position when the shaft 318' is positioned in the slot 366' of the keeper 326' in a second configuration (e.g., a second shaft configuration, FIGS. 15A and 15B). Some differences between the guide shoe 306 in the first position and the guide shoe 306' in the second position are described herein, and similar features are labeled with similar reference numbers, plus a single mark (').

With reference to FIGS. 13A-14, the shaft 318 is in the first configuration and the guide shoe 306 is in the first position. The central axis 323 is vertically offset from (e.g., positioned below) the shaft axis 358 about which the sprocket 278 rotates. The first shaft distance 394 between the first planar surface 350 (e.g., the upper planar surface) and the shaft axis 358 is less than the second shaft distance 400 between the second planar surface 354 (e.g., the lower planar surface) and the shaft axis 358. As a result, the axis of rotation of the sprocket 278 is elevated or spaced apart from the rack 294.

With reference to FIGS. 15A-16, the shaft 318' is in the second configuration and the guide shoe 306' is in the second position. The central axis 323' is vertically offset from (e.g., positioned above) the shaft axis 358' about which the sprocket 278' rotates. The second shaft distance 400' between the second planar surface 354' (e.g., the upper planar surface) and the shaft axis 358' is greater than the first shaft distance 394' between the first planar surface 350' (e.g., the lower planar surface) and the shaft axis 358'. As a result, the axis of rotation of the sprocket 278' is lower with respect to the rack 294' or positioned closer to the rack 294' than in the first configuration.

In some embodiments, an overlap distance 390, 390' (FIGS. 14 and 16) may be measured between the distal end 302, 302' of one of the rack teeth 298, 298' to the distal end 290, 290' of a sprocket tooth 282, 282' that is in a lowermost position. When the guide shoe 306 is in the first position, one of sprocket teeth 282 overlaps or penetrates between the rack teeth 298 by a first amount. When the guide shoe 306' is in the second position, one of sprocket teeth 282' overlaps or penetrates between the rack teeth 298' by a second amount. The first amount may be less than the second amount, and the overlap distance 390' (e.g., when the guide shoe 306' is in the second position) is greater than the overlap distance 390 (e.g., when the guide shoe 306 is in the first position).

The guide shoe 306, 306' can be switched between the first position and the second position by changing the orientation of the shaft 318 relative to the guide shoe 306, the first keeper 326, and the second keeper (e.g., by rotating the shaft 318 by 180 degrees).

When the shaft 318 is in the first configuration (FIGS. 13A-14), a distance between the second planar surface 354 and the rack 94 is less than a distance between the first planar surface 350 and the rack 94 (e.g., the second planar surface 354 is a lower surface). When the shaft 318 is in the second configuration (FIGS. 15A-16), a distance between the first planar surface 350 and the rack 94 is less than a distance between the second planar surface 354 and the rack 94 (e.g., the first planar surface 350 is a lower surface). The orientation of the shaft 318 can be changed by the operator. For example, the operator may first uncouple the first keeper 326 and the second keeper (e.g., by unfastening the fasteners). Then, the operator removes the first keeper 326 and the second keeper from the through holes and re-positions the shaft 318 to a different orientation. For example, the operator may rotate the shaft 318 by 180 degrees, thereby moving one of the planar surfaces 350, 354 to be positioned farther from the rack 294 and moving the other one of the planar surfaces 350, 354 to be positioned closer to the rack 294. The operator then repositioned the shaft 318' with respect to the keepers and secures the keepers to the guide shoe 306 (e.g., by fastening the fasteners).

It will be understood that the keepers 126, 128 described and illustrated in FIGS. 5-11 can be combined with the shaft 318 described and illustrated in FIGS. 13A-16, and may provide further increments of adjustment of the sprocket relative to the rack. For example, a guide shoe may include the keepers 126, 128 in the first configuration and the shaft 318 in the first configuration such that the axis of rotation of the sprocket is spaced from the rack by a distance that is greater than the distance provided by either the keepers 126, 128 or the shaft 318 alone. In another example, the guide shoe may include the keepers 126', 128' in the second configuration and the shaft 318' in the second configuration to have a larger overlap distance 190' than the overlap distance provided by either the keepers 126', 128' or the shaft 318' alone. Alternatively, the guide shoe may include keepers 126, 128 in either the first or second configuration and the shaft 318 in an opposite configuration, thereby providing an intermediate spacing compared to configurations when both the shaft support and the shaft are in the first configuration, or both are in the second configurations.

Although some aspects of certain embodiments have been described in detail, variations and modifications exist within the scope and spirit of one or more independent aspects as described.

What is claimed is:

1. A guide shoe for a mining machine, the guide shoe comprising:

a shoe body having a first end and a second end, the shoe body configured to engage a rack;

a through hole extending through a first wall of the shoe body and a second wall of the shoe body, the through hole extending along a central axis; and a support coupled to the first wall, the support configured to engage a shaft supporting a drive sprocket engaging the rack, the support includes a pin slot having a first slot edge and a second slot edge opposite the first slot edge, the pin slot having a slot center point that is vertically offset from the central axis.

2. The guide shoe of claim 1, wherein a first slot distance extends between the first slot edge and the central axis, and a second slot distance extends between the second slot edge and the central axis, wherein the first slot distance is greater than the second slot distance.

3. The guide shoe of claim 1, wherein a first slot distance extends between the first slot edge and the central axis, and a second slot distance extends between the second slot edge and the central axis, wherein the second slot distance is greater than the first slot distance.

4. The guide shoe of claim 1, wherein the support is selectively positionable within the through hole in a first support configuration and a second support configuration.

5. The guide shoe of claim 4, wherein a first slot distance extends between the first slot edge and the central axis, and a second slot distance extends between the second slot edge and the central axis, wherein, while the support is in the first support configuration, the drive sprocket is positioned at a first sprocket distance relative to the rack and, while the support is in the second support configuration, the drive sprocket is positioned at a second sprocket distance relative to the rack that is less than the first sprocket distance.

6. The guide shoe of claim 1, further comprising the shaft engaging the support, the shaft extending between the first wall and the second wall.

7. The guide shoe of claim 6, wherein the shaft defines an axis of rotation of the drive sprocket, and wherein a center point of the pin slot is offset from the axis of rotation.

8. A drive mechanism for a mining machine configured to engage and move the mining machine along a rack, the drive mechanism comprising:

a sprocket configured to engage the rack, rotation of the sprocket configured to move the mining machine relative to the rack;

a shaft supporting the sprocket for rotation about a rotation axis;

a guide shoe configured to maintain engagement between the sprocket and the rack, the guide shoe having a shoe body including a first end, a second end, a rack slot extending between the first end and the second end along a rack slot axis, a first wall, a second wall spaced apart from the first wall, and a through hole extending through the first wall and the second wall along a central axis; and a support coupled to the shoe body, the support including a shaft slot having a first slot edge and a second slot edge opposite the first slot edge, the shaft slot having a slot center point, the support coupled to the shaft, wherein at least one of the shaft and the support is movable between a first configuration and a second configuration, the rotation axis being spaced apart from the rack by a first sprocket distance in the first configuration, and the rotation axis being spaced apart from the rack by a second sprocket distance in the second configuration.

9. The drive mechanism of claim 8, wherein the rack includes a rack tooth and the sprocket includes a sprocket tooth, wherein in the first configuration the sprocket tooth overlaps the rack tooth by a first amount, wherein in the second configuration the sprocket tooth overlaps the rack tooth by a second amount, and wherein the first amount is less than the second amount.

10. The drive mechanism of claim 8, wherein the shaft extends along a shaft axis, the shaft axis being vertically offset from the central axis.

11. The drive mechanism of claim 10, wherein the shaft includes a first planar surface and a second planar surface, wherein a distance between the first planar surface and the central axis is a first shaft distance, and wherein a distance between the second planar surface and the central axis is a second shaft distance, the first shaft distance being different from the second shaft distance.

12. The drive mechanism of claim 11, wherein in the first configuration, the first shaft distance is greater than the second shaft distance.

13. The drive mechanism of claim 11, wherein in the second configuration, the first shaft distance is less than the second shaft distance.

14. The drive mechanism of claim 8, wherein the shaft extends along a shaft axis, the slot center point being vertically offset from the central axis.

15. The drive mechanism of claim 8, wherein the support further includes a first distance between the first slot edge and the central axis and a second distance between the second slot edge and the central axis, wherein the first distance is different from the second distance.

16. The drive mechanism of claim 8, wherein the support is selectively positionable within the through hole in the first configuration or the second configuration, wherein, while the support is in the first configuration, the sprocket is positioned at a first sprocket distance relative to the rack, and, while the support is in the second configuration, the sprocket is positioned at a second sprocket distance relative to the rack that is less than the first sprocket distance.

17. A guide shoe for a mining machine, the guide shoe comprising:

an elongated shoe body including a first end, a second end, a slot extending between the first end and the second end along a rack slot axis, a first lug, and a second lug spaced apart from the first lug, the first lug including a first opening extending along a central axis, and the second lug including a second opening that is aligned with the central axis;

a shaft for supporting a sprocket for rotation about a rotation axis, the shaft including a first end and a second end; and a pair of supports including a first support and a second support, the first support coupled to the first lug and engaging the first end of the shaft, the second support coupled to the second lug and engaging the second end of the shaft, wherein at least one of the shaft and the pair of supports is movable between a first configuration and a second configuration, the shoe body being supported in a first position relative to the sprocket in the first configuration, and the shoe body being supported in a second position relative to the sprocket in the second configuration.

18. The guide shoe of claim 17, wherein in the first position, the rack slot axis is positioned at a first distance from the rotation axis, and, in the second position, the rack slot axis is positioned at a second distance from the rotation axis.

19. The guide shoe of claim 17, wherein the first support is positioned in the first opening and includes a first slot, the first slot having a first slot edge and a second slot edge opposite the first slot edge, the slot having a slot center point that is offset from the central axis.

20. The guide shoe of claim 19, wherein a first slot distance extends between the first slot edge and the slot center point, and a second slot distance extends between the second slot edge and the slot center point, wherein the first slot distance is different from the second slot distance.

21. The guide shoe of claim 17, wherein the shaft includes a first planar surface and a second planar surface, wherein a distance between the first planar surface and the central axis is a first shaft distance, and wherein a distance between the second planar surface and the central axis is a second shaft distance, the first shaft distance being different from the second shaft distance.

* * * * *